US007302901B1

(12) United States Patent
Meyer

(10) Patent No.: US 7,302,901 B1
(45) Date of Patent: Dec. 4, 2007

(54) SELF-TACKING SWIVEL BASE

(76) Inventor: Brendan Gerald Meyer, 2114 Encinal Ave., Alameda, CA (US) 94501

( * ) Notice: Subject to any disclaimer, the term of this patent is extended or adjusted under 35 U.S.C. 154(b) by 4 days.

(21) Appl. No.: 11/494,857

(22) Filed: Jul. 28, 2006

(51) Int. Cl.
*B63B 21/04* (2006.01)
*B66D 3/04* (2006.01)

(52) U.S. Cl. ..... 114/218; 254/415

(58) Field of Classification Search ..... 114/218
See application file for complete search history.

(56) References Cited

U.S. PATENT DOCUMENTS 2,343,054 A * 2/1944 Gwinn, Jr. et al. ..... 254/415

4,160,541 A * 7/1979 Harken et al. ..... 254/395

* cited by examiner

*Primary Examiner*—Jesús D Sotelo

(57) ABSTRACT

An improved sailboat swivel base consisting of a rotating arm that supports both a guide pulley on one end and a rope securing cleat on the opposite end. The arm swivels about a center bearing, housed in a base which is fastened to a fixed structure such as the deck of a boat. A sail control rope, passing through the guide pulley and secured by the cleat, is tensioned by the force of the sail. The tension force of the line pulls the guide pulley end of the rotating arm toward the sail and sends the securing cleat away from the sail. This rotation aligns the cleat with the direction of pull for easy operation. When the sailboat changes tacks and the sails reverse position the rotating arm will follow the sail to the new side and self-tack the swivel base.

2 Claims, 2 Drawing Sheets

SELF-TACKING SWIVEL BASE

BACKGROUND

1. Field of Invention

This invention relates to block-and-tackle equipment and more particularly to a piece of equipment known as a "swivel base," which is used on a large variety of sailing craft for the control and adjustment of various ropes and lines.

2. Description of Prior Art

On a typical sailing craft there are a number of ropes and lines that control the positioning and adjustment of sails, poles, and the various types of hardware needed for the operation of the craft. These lines are often secured by means of a device known as a cleat, which is affixed to the craft. The cleat is often mounted on a swivel base in order to facilitate the securing and releasing of the control lines. The swivel base allows for the rotation of the cleat so that the line can be adjusted from a variety of positions. A block or pulley is also mounted to the same swivel base to provide the line a fair lead into the cleat.

The basic form of the swivel base consists of a circular base mounted to the craft. The base supports an outwardly extending arm that can rotate about the base center. At the end of this arm is mounted the securing cleat. In addition, the pulley is mounted at the base center. A control line is passed through the pulley and then through the cleat. Adjusting the tension allows the control line to be either pulled in or let out; securing the line then effects the adjustment.

Prior art is illustrated by the Harken Swivel Base, U.S. Pat. No. 4,160,541 to Harken/Lawsen (1979). This device is known to have eliminated the problems associated with other similar devices; said problems include excessive free play in the lever arm, difficulty in releasing the line from the cleat, and excessive friction in the pivot bearing. There is one major problem that the Harken Swivel Base and all prior art swivel bases share: when the control line is secured by the cleat and the free end is released, the cleat end of the rotating arm is drawn toward the direction of load, typically the direction opposite from which the line was adjusted. In order to readjust the control line it, the operator must then reach around the swivel base, pick up the loose line, rotate the swivel base cleat back toward the direction of adjustment, and adjust the line.

The aforementioned problem occurs when, for example, a swivel base is used to control the mainsheet. Typically, the working end of the mainsheet in connected to the mainsail by means of a multiple-pulley system with lines running from the boom to the deck and then finally from the last boom pulley through the swivel base pulley and into the cleat. The boom is pushed toward the leeward side of the craft when the mainsheet is filled with wind. Typically, the person adjusting the mainsheet is positioned on the windward side of the craft opposite the pull of the boom. When the mainsheet is cleated and dropped, the swivel base cleat will rotate toward the boom and the leeward side of the craft. To reach and adjust the mainsheet, the operator must come down from the windward side of the craft, reach to the leeward side and pick up the mainsheet, pull the cleat back to the windward side, and then adjust the line.

OBJECTS AND ADVANTAGES

Accordingly, besides the objects and advantages of the swivel base described in my abovementioned patent, several objects and advantages of the present invention are:

(a) to provide a swivel cleat that will align itself with the direction of adjustment.

(b) to provide a swivel cleat that will self-tack when the direction of load is reversed.

DRAWING FIGURES

REFERENCE NUMERALS IN DRAWINGS

| | |
|---|---|
| 10 | bearing block assembly |
| 12 | stationary part of sailing craft |
| 14 | through bolts (4) |
| 16 | swivel arm |
| 18 | center axis of rotation |
| 20 | cam cleat |
| 20a | jaws |
| 22 | control line |
| 24 | upturned tab |
| 26 | hole |
| 28 | pulley |
| 30 | shackle |
| 30a | removable pin |
| 32 | notches |
| 34 | spring |
| 36 | U-shaped strap |
| 38 | circular opening |
| 40 | bottom plate |
| 42 | boss |
| 44 | upper plate |
| 46 | face |
| 48 | annular recess |
| 50 | ball bearings |
| 52 | washer |
| 54 | stop bolt(s) |
| 56 | holes (3) |
| 58 | stop lugs (2) |

DESCRIPTION

Figure 1:
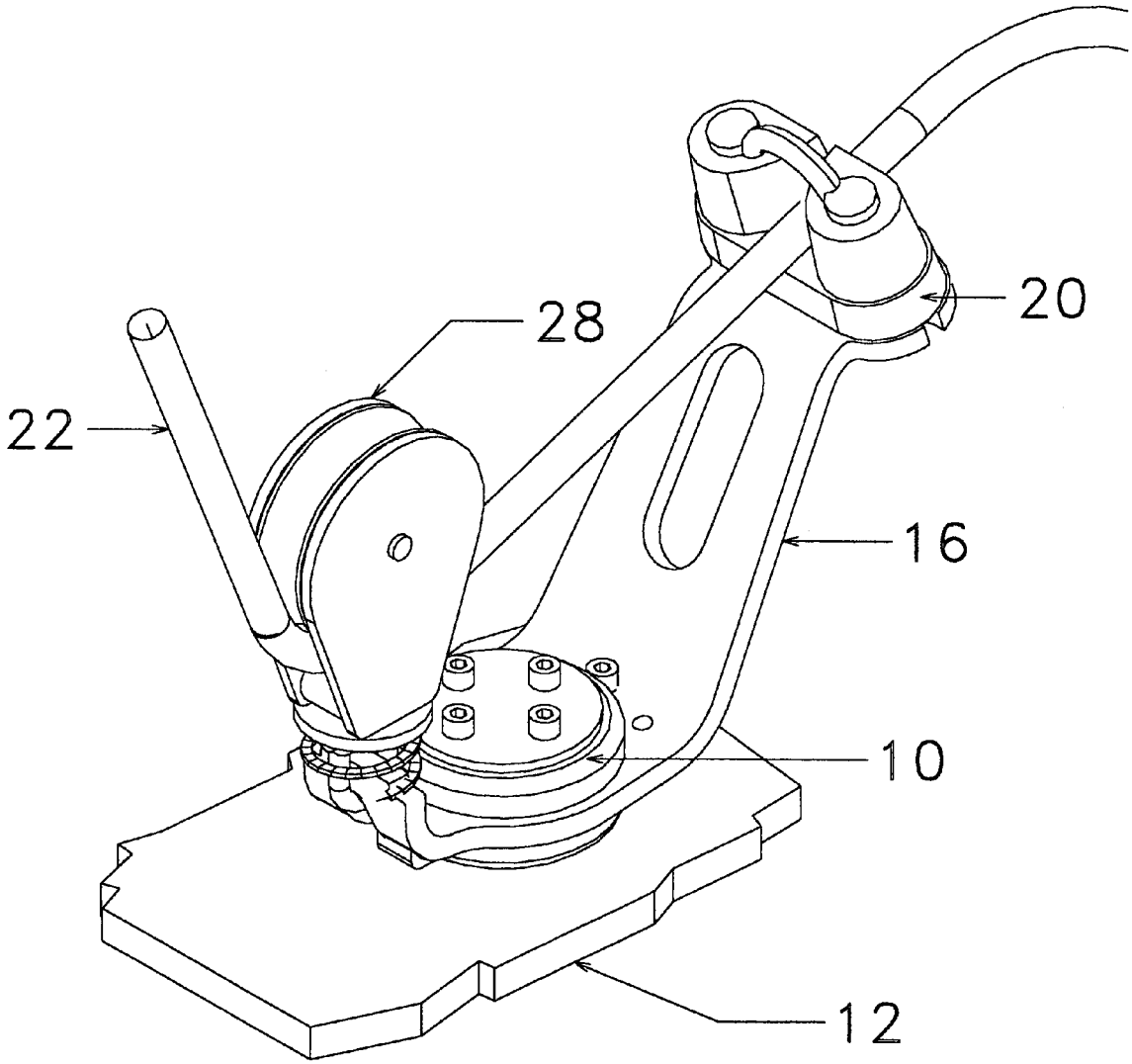
FIG. 1 shows the assembled self-tacking swivel base with guide pulley and cam cleat attached.
Figure 2:
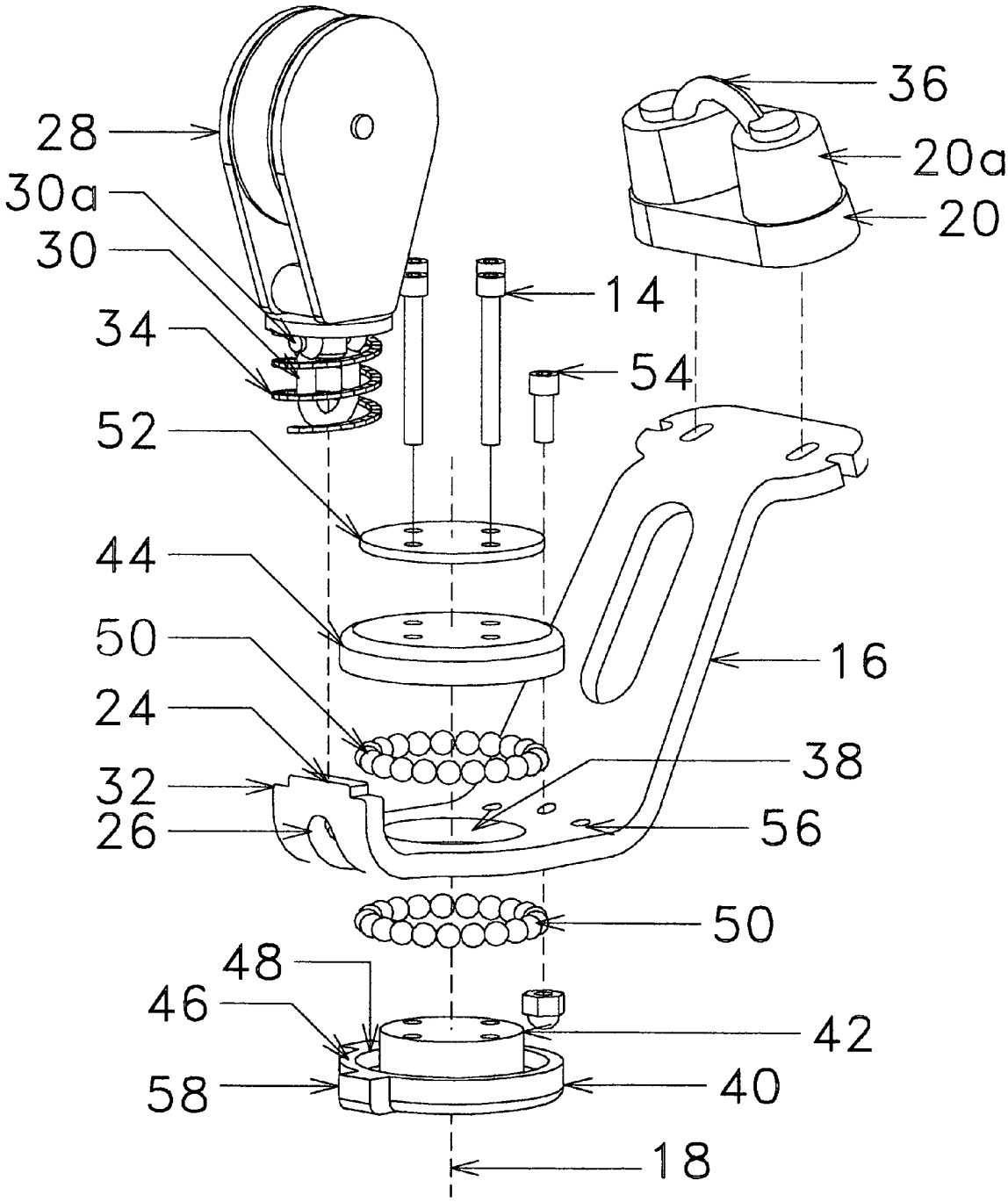
FIG. 2 shows an exploded view of the self-tacking swivel base.

FIGS. 1 to 2

A typical embodiment of the swivel base of the present invention is illustrated in FIG. 1. The mounting base comprises a generally cylindrical bearing block assembly 10 secured to some stationary part of the sailing craft 12 by means of through bolts 14 or screws. A plate-like swivel arm 16 is supported in its middle so that it can rotate about the center axis of rotation 18 of the bearing block assembly. At one end of the arm is mounted a line-securing device such as a cam cleat 20 into which the control line 22 can be quickly locked at the desired position or quickly released as needed. At the opposite end of the swivel arm is an upturned tab 24 through which a hole 26 has been machined. This hole provides a point at which to mount a conventional pulley 28 by means of a shackle 30 with a removable pin **30*a*. For many applications this pulley may contain a one-way ratchet mechanism to provide resistance to the pull of the control line. The upturned tab has two notches 32 machined into its upper edge for the purpose of locating a spiral wound spring 34. This spring is compressed between the bottom surface of the pulley 28 and the top edge of the upturned tap 24**. This compression provides the force needed to support the pulley in a generally upright position.

The cam cleat 20 includes a pair of rotatable spring-loaded jaws 20*a* bearing teeth which reasonably grip the line 22. As shown in FIGS. 1 and 2, the swivel arm 16 is formed in a manner whereby the cam cleat 20 will be supported adjacent the exit side of the pulley 28 and in a spaced relationship therewith. Also, a U-shaped strap 36 of metal or plastic is preferably secured between the pivots of the two jaws to hold the control line near the cleat 20.

The swivel base construction is best seen with reference to FIG. 2. The swivel arm is best made from highly corrosion-resistant plate such as aluminum, stainless steel, or titanium. This swivel arm has a circular opening 38 machined near the middle, through which opening the bearing block assembly 10 is received. As exemplified by prior art, the preferred form the bearing assembly comprises a lower portion or bottom plate 40 having a centrally located boss 42 received through the opening 38 of the swivel arm 16. A corresponding upper portion or top plate 44 abuts the end face of the boss 42, and the two portions are held in assembled relationship by a number of through bolts or screws 14.

The bottom plate 40 has an upper face 46 with a upwardly facing annular recess 48 near the outermost limit containing a number of ball bearings 50. A similar recess, containing an equal number of ball bearings 50, is located in the bottom face of the upper plate facing downward. When assembled, the swivel arm is held captive between the upper and lower races of ball bearings but is allowed to rotate freely in the radial direction.

A bearing washer 52 with holes for through bolts 14 is located directly above the top plate. When the bearing washer is mounted in the operating position, four through bolts pass through the bearing washer, top plate, lower plate, and then deck or other mounting structure. This bearing washer 52 is best made from highly corrosion-resistant plate, such as aluminum, stainless steel, or titanium, which is capable of distributing tension and shear loads from the through bolts into the top plate.

A stop bolt(s) 54 may be positioned either in the center of the three holes 56 or in the outer two holes so as to limit the amount of rotational movement of the swivel arm. The stop bolt(s) 54, by engaging the stop lugs 58, prevent the further rotation of the swivel arm.

From the description above, a number of advantages of my self-tacking swivel base become evident.

(a) When cleated, the swivel base will align itself with the direction of load.

(b) When the direction of the load changes, the swivel base will readjust its alignment to the new direction of the load.

(c) When the craft is tacked onto a new heading and the sails fill on the new side of the craft, the swivel will self-tack itself so that the control line is readily accessible for adjustment.

OPERATION

The manner of using the self-tacking swivel base is identical to that of swivel bases in present use. A control line is led first through a guiding pulley mounted at one end of the swivel arm and then into a cleat mounted on the opposite end of the swivel arm. A U-strap mounted on top of the cleat maintains the control line near to the jaws of the cleat and also acts to guide the control line back into the jaws in order to secure the line. The control line is adjusted in by pulling the line through and down into the cleat to secure. To adjust out, the control line is lifted out of the cleat jaws, eased to the desired position, and then pulled down into the cleat to secure. Once the control line is cleated and released, all known swivel bases in current use tend to rotate the cleat toward the direction of loading, generally away from the position from which the control line was adjusted. My self-tacking swivel base eliminates this problem. When the control line is cleated and released, the tension on the control line continues to align the guiding pulley toward the direction of load. This maintains the cleat end of the swivel arm toward the direction of adjustment. As further adjustment is needed, the control line remains within easy reach.

Also, when the sailing craft tacks or jibs and the mainsail crosses to the other side of the craft, my invention will self-tack to a new position so that the guide pulley continues to align itself with the load form the sail. This allows the person adjusting the control line to easily reach the released line from a new position opposite the mainsail. All known swivel bases in current use will tend to rotate toward the new load of the mainsail and away from the person adjusting the control line.

VARIATIONS

Although the above description is specific, many variations are possible within the teachings of the invention. For example, the bearing block assembly with ball bearings may be replaced with a slide-bearing base that also rotates about a central axis. The guide pulley may be replaced with a solid fairlead mounted in the same position at the end of the swivel arm. Any number of line securing devices may be used to secure the control line at the end of the swivel opposite the guide pulley or fairlead. Therefore, the scope of the invention should be determined by the appended claims and their legal equivalents, not by the examples given.

I claim:

1. A self-aligning swivel base for the purpose of securing a tensioned rope at a desired position, comprising:

a) a fixed base having a circular bearing b) an elongated plate of rigid material sandwiched and held captive in the central portion by said fixed base and allowed to rotate about said circular bearing c) a rope securement device mounted on one end of said elongated plate d) a guide device mounted on the end of said elongated plate opposite said rope securement device whereby the tension of the secured rope will rotate the elongated plate into an aligned position.

2. The self-aligning swivel base of claim 1 wherein said guide device is selected from the group consisting of a pulleys, blocks, and fairleads.

* * * * *